United States Patent [19]

Bryan, Jr.

[11] 4,018,165

[45] Apr. 19, 1977

[54] TIE REPLACING SYSTEM

[76] Inventor: John F. Bryan, Jr., 3212 Mapleleaf Circle, Dallas, Tex. 75233

[22] Filed: Dec. 5, 1974

[21] Appl. No.: 530,016

Related U.S. Application Data

[62] Division of Ser. No. 319,004, Dec. 27, 1972, Pat. No. 3,881,422.

[52] U.S. Cl. ..... 104/9; 37/108 A

[51] Int. Cl.[2] ..... E02F 5/00; E01B 29/06

[58] Field of Search ..... 254/43; 104/6, 9, 2; 37/108

[56] References Cited

UNITED STATES PATENTS

| | | | |
|---|---|---|---|
| 2,097,430 | 11/1937 | Brown | 104/9 |
| 3,349,717 | 10/1967 | Blix, Jr. et al. | 104/9 |
| 3,496,883 | 2/1970 | Bodine | 104/9 |

*Primary Examiner*—Robert R. Song
*Assistant Examiner*—Richard A. Bertsch
*Attorney, Agent, or Firm*—Richards, Harris & Medlock

[57] ABSTRACT

A tie replacing system is adapted to replace worn ties in a railroad track of the type including longitudinally extending metal rails supported on wooden cross ties by metal tie plates and a gravel ballast roadbed supporting and at least partially enclosing the ties. The system includes a tie biter-tie plate holder assembly comprising a pair of opposed jaws each including a plurality of teeth positioned at spaced intervals across the entire width of a worn tie. Upon closure of the jaws, the teeth function to remove any portion of the worn tie which projects above the under surfaces of the tie plates. The jaws also include tie plate gripping members which engage the tie plates corresponding to the worn tie and thereby retain the tie plates in engagement with the under surfaces of the rails.

14 Claims, 17 Drawing Figures

TIE REPLACING SYSTEM

This is a division of application Ser. No.. 319,004, filed Dec. 27, 1972, now U.S. Pat. No. 3,881,422.

A tie pushing-tie pulling mechanism is supported on an articulated arm assembly for movement along a path extending substantially axially of the worn tie. By this means the worn tie is pushed out from under the tie plates and the rails and out of the roadbed of the railroad track, and a replacement tie is subsequently pulled into the roadbed and into position beneath the tie plates and the rails of the railroad track. The tie pushing-tie pulling mechanism comprises a vibrator for generating vibrations of substantial amplitude and thereby facilitating both the movement of the worn tie out of the roadbed and the movement of the replacement tie into the roadbed. A scarifyer is provided for scarifying the portion of the roadbed immediately adjacent the position previously occupied by the old tie and thereby facilitating movement of the replacement tie into the roadbed. Finally, the tie pushing-tie pulling mechanism is provided with a pair of opposed jaws for gripping the replacement tie during the tie pulling operation.

The articulated arm assembly is supported from a crosshead which also supports an anchor mechanism. The anchor mechanism functions to engage the roadbed at the opposite end of the worn tie from the tie pushing-tie pulling mechanism, whereby the reaction force caused by the tie pushing operation is directed into the roadbed. A tie thrower assembly is supported on the anchor mechanism and functions to receive the worn tie as it is pushed out of the roadbed and to propel the worn tie away from the railroad track.

The system further includes a bumper for positioning replacement ties lying on the railroad track and tie elevator for receiving replacement ties from the tie bumper. A conveyor receives the replacement ties from the tie elevator, and a cross conveyor positions each replacement tie directly above the point at which a worn tie has been removed from the roadbed. Thereafter, a tie feeder moves the replacement tie into engagement with the jaws on the tie pushing-tie pulling mechanism, whereupon the tie pushing-tie pulling mechanism functions to pull the replacement tie into position beneath the rails and the tie plates of the railroad track. During the tie pulling operation, the tie feeder and the teeth of the tie biter-tie plate holder assembly function to guide the replacement tie.

BACKGROUND AND SUMMARY OF THE INVENTION

This invention relates to tie replacing systems, and more particularly to a fully automatic tie replacing system which is both economical in use and capable of very high speed operations.

At the present time there is renewed interest in the use of railroads for high speed inter-urban mass transportation, particularly in the eastern and northern sections of the country where the cities have literally grown together. Federal regulations have established track maintenance standards which, for purposes of safety, limit the speed of trains in accordance with track conditions. Therefore, in order to provide high speed railroad transportation, be it inter-urban in nature or cross country, it is necessary that the various railroad tracks traversing the United States be generally upgraded. This effort must of course be carried on in addition to normal maintenance of way activities.

There are, of course many factors involved in upgrading a railroad track. For example, it is now considered desirable to connect adjacent rails of a railroad track with welded joints rather than by means of conventional bolted joints. This is advantageous not only in providing a quieter and smoother ride, but also in reducing damage to rolling stock caused by vibrations and shock. It is also often necessary to renew and/or replace the roadbed which supports the railroad track, particularly the ballast. Finally, the ties which support the rails of the track on the roadbed must be replaced on a periodic basis. The average wooden railroad tie should be replaced after about 30 years of service.

Heretofore the replacement of ties in a railroad track has typically involved a large number of independent, time consuming steps. First, the ties to be replaced are identified, the rail anchors are removed, and the ties are unspiked. Since the tie plates which support the rails on the ties are often buried in the older ties to a greater or lesser degree, and since raising the track to remove the old tie is not desirable for several reasons, it is often necessary to employ a tie saw to cut the old ties into three pieces. A tie crane is then employed to remove the pieces and to position them adjacent the railroad track.

A second tie crane is typically employed to position a new tie for insertion beneath the rails of the track. Various semi-automatic mechanisms have heretofore been designed, any of which may be employed to push or pull the new ties onto the rails. Finally, the ballast structure around the new ties is restored, and the spikes and the rail anchors are replaced, The present invention comprises a tie replacing system incorporating numerous advantages over the foregoing procedure. In accordance with the broader aspects of the invention, any portions of a worn tie which extend above the tie plates are first removed, and the tie plates are simultaneously gripped and thereby maintained in engagement with the under surfaces of the rails. Thereafter a tie pushing-tie pulling mechanism supported on an articulated arm is forced beneath the rails, whereby the worn tie is pushed out from under the rails. The worn tie is thrown clear of the track structure, and the new tie is delivered to the tie pushing-tie pulling mechanism. The articulated arm is then actuated to withdraw the tie pushing-tie pulling mechanism from beneath the rails, whereby the new tie is pulled into the position previously occupied by the worn tie. By this means the worn tie is replaced in a single operation which is much faster and much less expensive than prior tie replacing processes.

In accordance with more specific aspects of the invention, an anchor arm is engaged with the track supporting structure on the oposite side of the track from the point of entry of the tie pushing-tie pulling mechanism. By this means the reaction force which is generated as the old tie is pushed out from under the rails is absorbed in the track supporting structure, and is not applied to the rails per se. The tie pushing-tie pulling mechanism includes a vibrating mechanism which aids in the movement of the worn and replacement ties out of and into the roadbed, respectively, and a pair of opposed jaws which are utilized to grip the new tie as it is pulled into position. The tie pushing-tie pulling mechanism also includes a scarifyer which adapts the roadbed to receive the new tie.

The portions of the worn tie which project above the tie plates are preferably removed by a tie biter-tie plate holder assembly. As the old worn tie is pushed out from under the rails, the new tie is simultaneously positioned above the point at which the worn tie is removed from the track structure. Thereafter, a tie feeder operates in conjunction with the force of gravity to rapidly move the replacement tie into engagement with the jaws of the tie pushing-tie pulling mechanism. The tie biter-tie plate holder assembly and the tie feeder also guide the replacement tie during the tie pulling operation.

DESCRIPTION OF THE DRAWINGS

A more complete understanding of the invention may be had by referring to the following Detailed Description when taken in conjunction with the accompanying Drawings, wherein.

DETAILED DESCRIPTION

Figure 1:
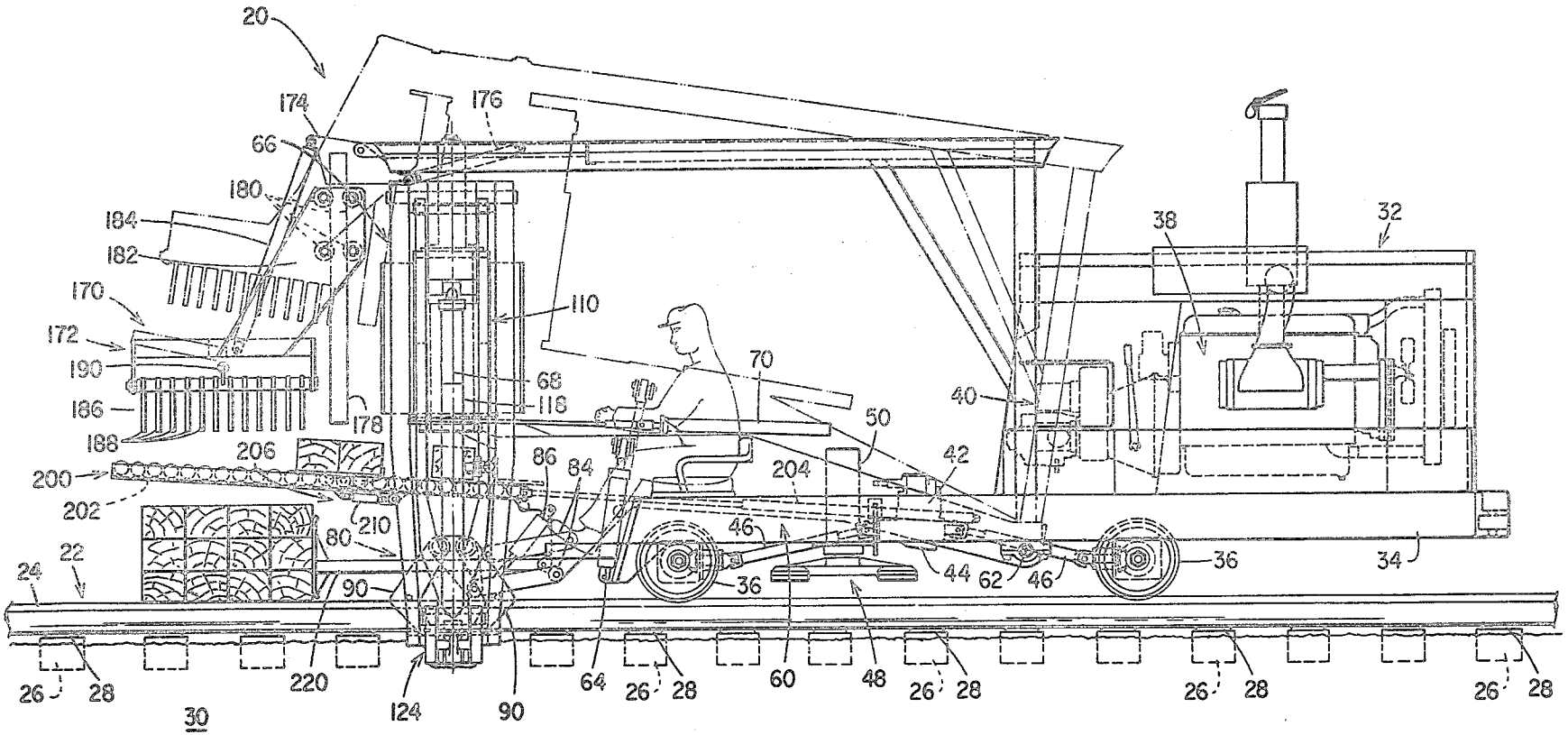
FIG. 1 is a side view of a tie replacing system incorporating the invention showing the component parts of the system in the working positions.

Referring now to the Drawings, and particularly to FIG. 1 thereof, there is shown a tie replacing system 20 incorporating the present invention. The tie replacing system 20 is adapted to replace worn ties in a railroad track 22 of the type comprising longitudinally extending steel rails 24 which are supported on transversely extending wooden ties 26 by steel tie plates 28. The ties 26 are in turn supported by a roadbed 30 principally comprising a gravel ballast layer extending around and substantially enclosing the ties 26.

The tie replacing system 20 comprises a vehicle 32 including a main frame 34 which is supported for movement along the railroad track 22 by a plurality of flanged wheels 36. An internal combustion engine 38 is supported on the extreme rear end of the main frame 34 and functions to drive the various operating instrumentalities of the tie replacing system 20. For example, the engine 38 drives a plurality of hydraulic pumps 40 supported on the main frame 34 just forwardly of the engine 38.

The vehicle 32 and hence the entire tie replacing system 20 is propelled by a hydrostatic drive 42 which drives a two speed transfer case 44. The transfer case 44 is in turn connected to the wheels 36 by a pair of drive shafts 46 and conventional differential gearing. A turntable 48 is positioned directly beneath the center of gravity of the tie replacing system 20 and is adapted for actuation by a hydraulic cylinder 50 to raise the entire tie replacing system 20. This is useful both in positioning the tie replacing system 20 onto and off of the track 22 and in turning the tie replacing system around.

The tie replacing system 20 further includes a work frame 60 which is supported on the main frame 34 for pivotal movement about an axis 62 located just forwardly of the rear wheels 36. A pair of hydraulic cylinders 64 are provided for selective actuation to raise or lower the work frame 60 relative to the main frame 34 in the manner indicated by the dashed lines in FIG. 1. This is useful not only in manipulating the work frame 60 between traveling and working positions, but also in adjusting the positioning of the operating components of the tie replacing system 20 in accordance with the height of the rails 24 of the railroad track 22.

Figure 2:
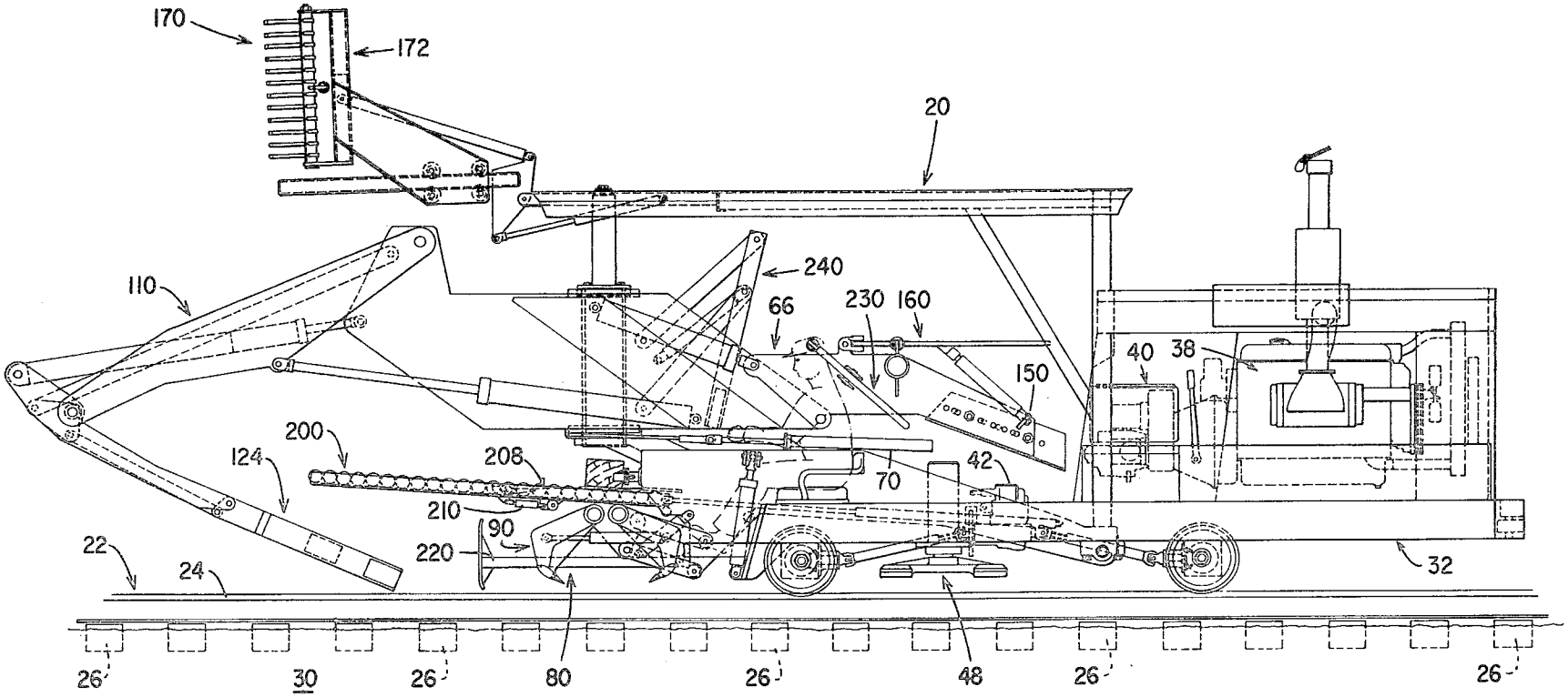
FIG. 2 is a view similar to FIG. 1 showing the component parts of the system in the traveling positions.
Figure 3:
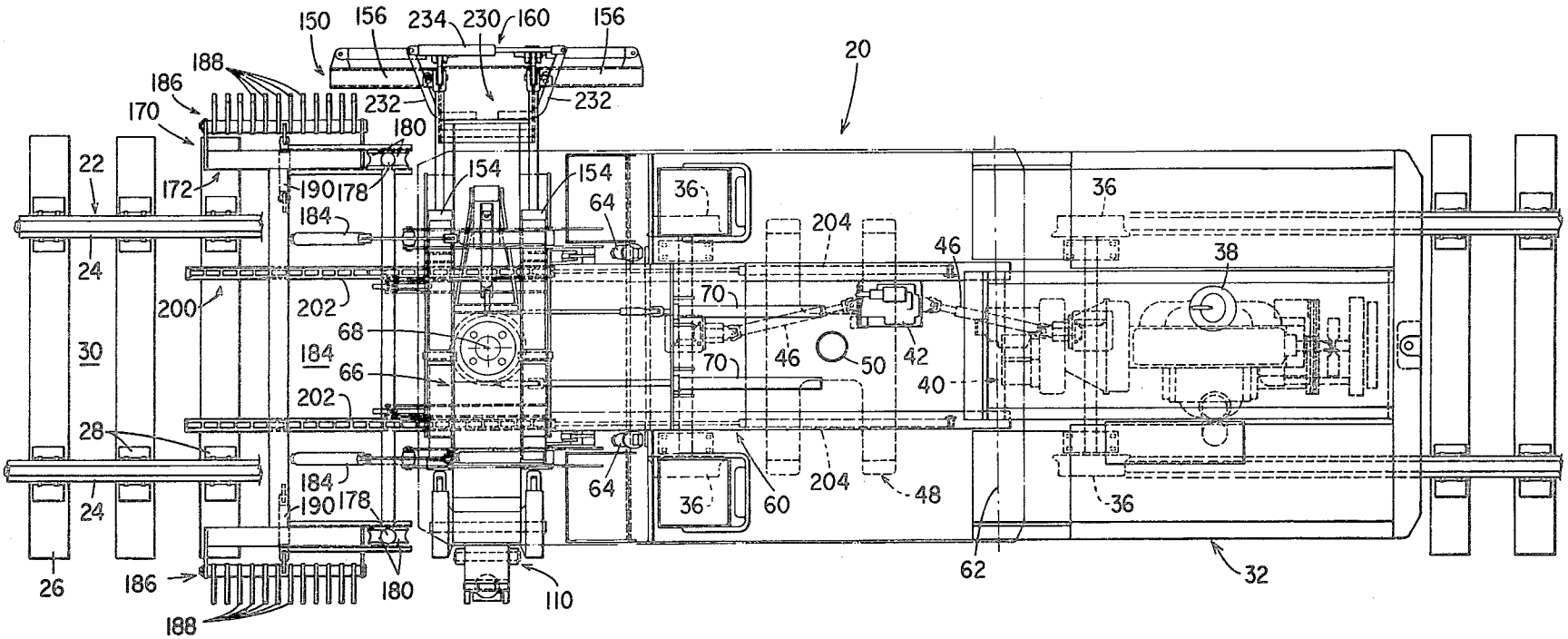
FIG. 3 is a top view of the system.

The work frame 60 of the tie replacing system 20 supports a crosshead 66 which is suppoted on the work frame 60 for pivotal movement about an axis 68. As is best shown in FIG. 3, the positioning of the crosshead 66 is controlled by a pair of hydraulic cylinders 70 which are connected to the crosshead 66 by a cable 72. By this means the operating components of the tie replacing system 20 are selectively positionable in either a right hand orientation or a left hand orientation relative to the railroad track 22, or in the traveling orientation shown in FIG. 2.

The mounting of the operating components of the tie replacing system 20 for selective positioning in right hand, left hand or traveling positions provides a number of highly advantageous characteristics in the present invention. First, when the operating components of the system are positioned as shown in FIG. 2, all presently existing limitations regarding the size of railway vehicles are complied with. By this means the tie replacing system 20 is adapted for relatively high speed transportation, i.e., about 20 mph, to the location of ties to be replaced. Since all existing size limitations are complied with, such transportation may be accomplished without danger of interference from rolling stock on adjacent tracks, overhead obstructions, etc.

Perhaps more importantly, the ability to position the operating components of the tie replacing system on either side of the track 22 is highly important to the successful operation of the system. It will be appreciated that in many instances the removal of ties from one side or the other of the track may be necessary, or at least highly desirable. For example, in the case of curved track sections or other instances wherein the railroad track is banked, it may be impossible to remove the ties 26 from one side or the other of the track. Even in instances in which it is possible to remove the ties from either side, various considerations may render removal of the ties to one side or the other highly desirable from a convenience standpoint. It will thus be understood that the support of the crosshead 66 for rotation with respect to the work frame 60 is a significant feature of the present invention.

Referring now to FIGS. 2, 4*a* through 4*d*, and 6, the tie replacing system 20 is provided with a tie biter-tie plate holder assembly 80. As will be appreciated by those skilled in the art, the combined actions of mechanical wear and loss of bearing strength results in the phenomenon of plate cutting, wherein the portions of the tie beneath the tie plates may be depressed two or more inches beneath the upper surfaces of the remainder of the tie. The function of the tie biter-tie plate holder assembly 80 is to remove any portion of the tie which projects above the under surfaces of the tie plates. The tie biter-tie plate holder assembly 80 also functions to secure the tie plates in engagement with the under surface rail while the worn tie is removed and the new tie is inserted beneath the tie plates. The consideration underlying both these functions is the removal of the worn tie and the replacement thereof without the necessity of lifting the rails of the railroad track.

Figure 4A:
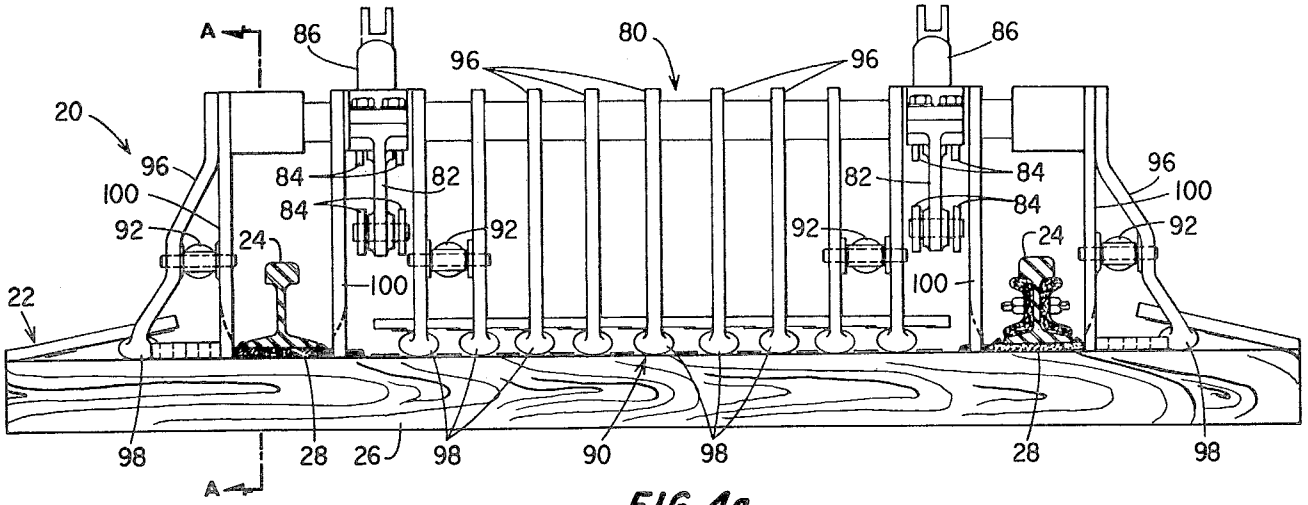
FIGS. 4*a*, 4*b*, 4*c* and 4*d* are illustrations of the construction and the operation of the tie biter-tie plate holder assembly of the system.
Figure 4C:
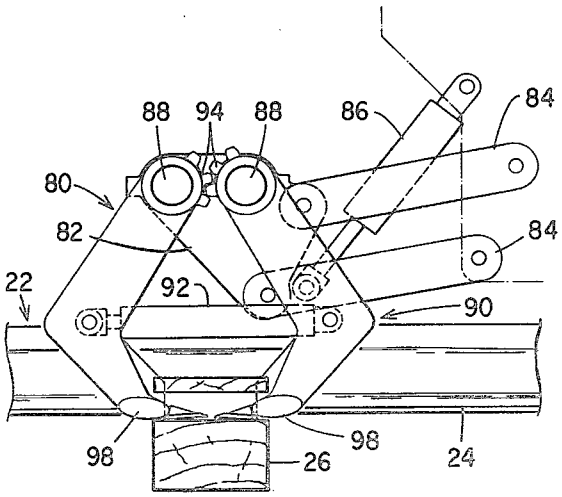
Figure 4D:
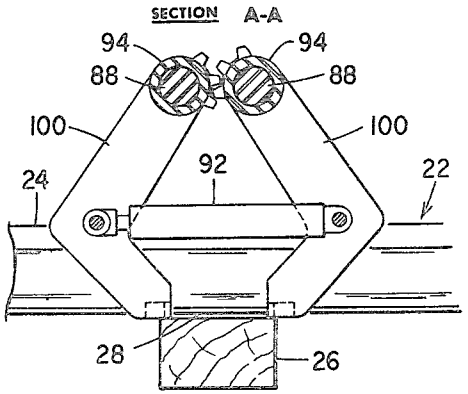
Figure 4B:
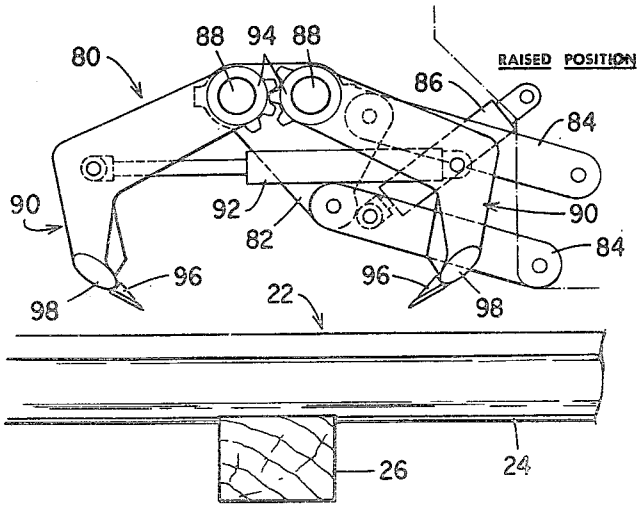

As is best shown in FIGS. 4*a* and 4*b*, the tie biter-tie plate holder assembly 80 includes a subframe 82 which is supported on the work frame 60 by a pantograph linkage including spaced sets of parallel links 84. A pair of hydraulic cylinders 86 are provided for selective actuation to raise and lower the tie biter-tie plate holder assembly 80 relative to the work frame 60.

The subframe 82 includes a pair of parallel shafts 88 each of which rotatably supports a tie biting-tie plate holding jaw 90. A set of hydraulic cylinders 92 is provided for opening and closing the jaw 90, and two sets of meshing gear segments 94 are provided to assure equal and opposite motion of the jaws 90 under the action of the cylinders 92.

As is best shown in FIG. 4*b*, each jaw 90 of the tie biter-tie plate holder assembly 80 comprises a plurality of tie biting teeth 96. The teeth 96 are located at spaced intervals across the entire width of the tie 26 comprising the railroad track 22. Each tooth 96 includes a rounded heel 98 comprising the lowermost portion of the tooth.

The jaws 90 further comprise tie plate gripping members 100. The tie plate gripping members 100 are mounted on opposite sides of the rails 24 and are therefore positioned for gripping engagement with the tie plates 28 of the railroad track 22.

In the operation of the tie biter-tie plate holder assembly 80, the subframe 82 is initially lowered relative to the work frame 60 by actuation of the hydraulic cylinders 86. During this action the subframe 82 is manipulated from the position shown in FIG. 4*b* to the position shown in FIG. 4*c*. When the subframe 82 is properly positioned, the hydraulic cylinders 92 are retracted to close the jaws 90. Under this action the teeth 96 engage the cut away by shearing action any portions of the tie 26 which project above the lower surfaces of the tie plates 28. At the same time the tie plate gripping members 100 engage and grip the tie plates 28 by the opposite edges thereof in the manner shown in FIG. 1. By this means the tie plates 28 are maintained in engagement with the under surfaces of the rails 24. The widths of the tie plates impose a limit on the closure of the jaws 90. When the jaws are fully closed, the teeth 96 are separated by a small distance, but are sufficiently closely engaged so that any portion of the tie 26 which may have projected above the under surfaces of the tie plates 28 is positively sheared therefrom.

Figure 6:
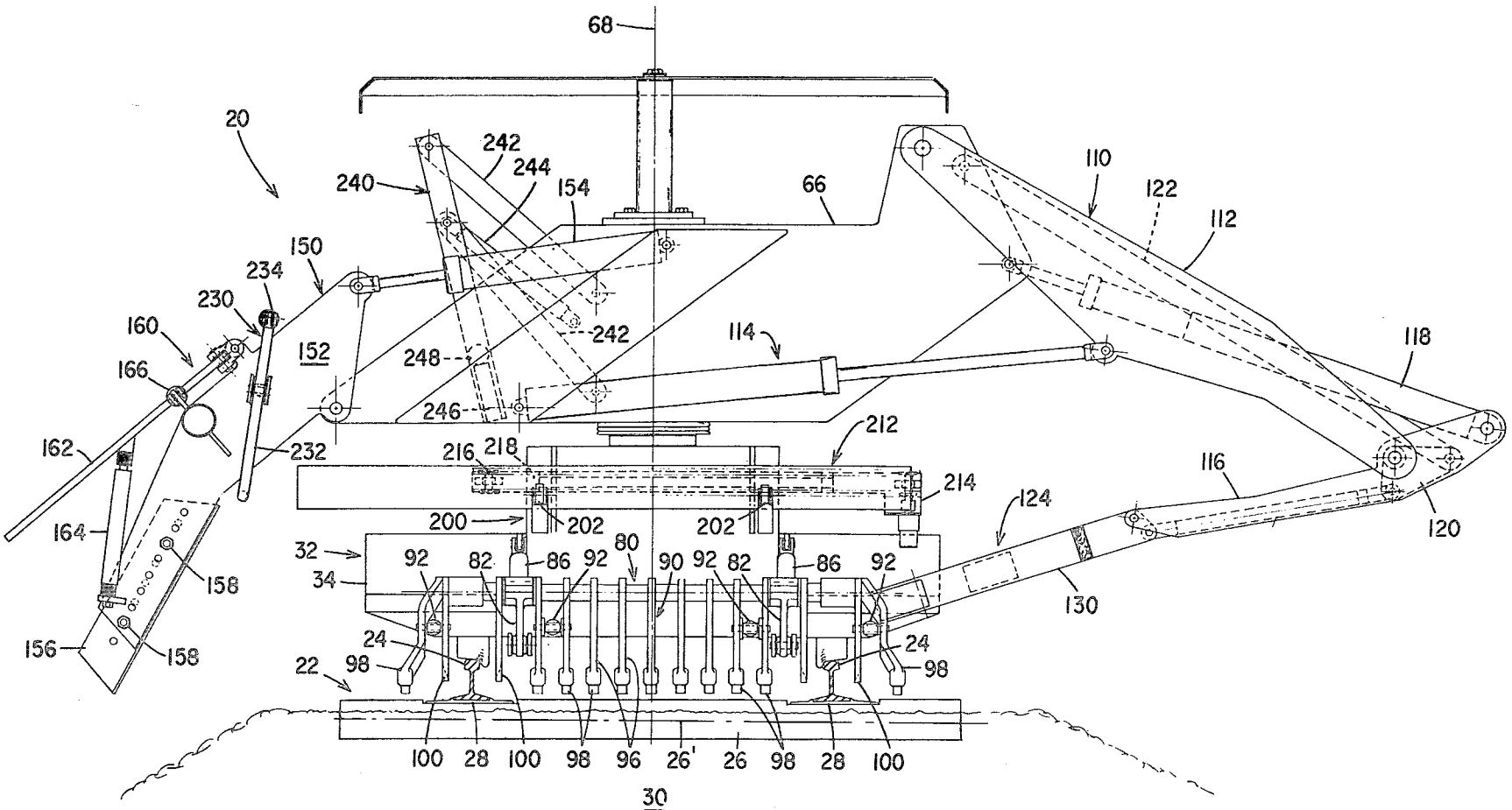
FIGS. 6 through 9 comprise illustrations of progressive steps in the operation of the tie replacing system.

Referring now to FIG. 6, the tie replacing system 20 further includes an articulated arm assembly 110. The assembly 110 includes a primary arm 112 which is pivotally supported on the crosshead 66. A pair of hydraulic cylinders 114 are connected between the crosshead 66 and the primary arm 112 and functions to control the pivotal positioning of the primary arm. A secondary arm 116 is pivotally supported on the distal end of the primary arm 112, and a hydraulic cylinder 118 is connected between the crosshead 66 and the arm 116. The cylinder 118 functions to position the operating components supported by the articulated arm assembly 110 during transit of the tie replacing system 20.

A bell crank 120 is also pivotally supported on the distal end of the primary arm 112. A control link 122 is connected between the crosshead 66 and the bell crank 120. It will thus be understood that the primary arm 112, the bell crank 120 and the control link 122 form a pantograph linkage which functions to maintain a constant angular relationship between the bell crank 120 and the crosshead 66. A tie pushing-tie pulling mechanism 124 is supported on the distal end of the secondary arm 116. A link 126 is connected between the tie pushing-tie pulling mechanism 124 and the bell crank 120. Thus, a second pantograph linkage is established including the bell crank 120, the secondary arm 116, the link 126, and the tie pushing-tie pulling mechanism 124. These two pantograph linkages function to determine the path followed by the tie pushing-tie pulling mechanism 124 in response to actuation of the hydraulic cylinders 114.

The construction of the tie pushing-tie pulling mechanism 124 is illustrated in FIGS. 5*a* through 5*c*, and 6. The mechanicam 124 includes a frame 130 and a subframe 132 slidably supported thereon. A hydraulic cylinder 134 is connected between the frame 130 and the subframe 132 and is adapted to extend and retract the subframe 132 relative to the frame 130.

A pair of opposed jaws 136 are pivotally supported on the frame 130 and are connected to the subframe 132 by a pair of links 138. As is most clearly shown in FIG. 5*c*, a scarifyer tooth 140 depends from each jaw 136. A pneumatic vibrator 142 is supported at the distal end of the subframe 132.

Figure 5A:
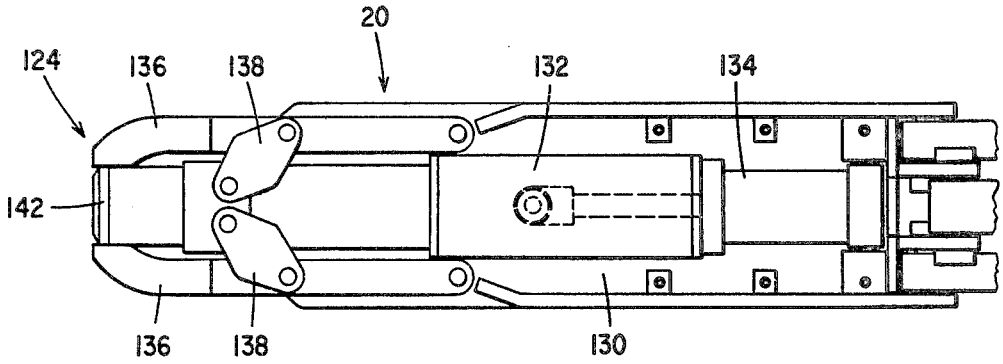
FIGS. 5*a*, 5*b* and 5*c* are illustrations of the construction and operation of the tie pushing-tie pulling mechanism of the system.
Figure 5B:
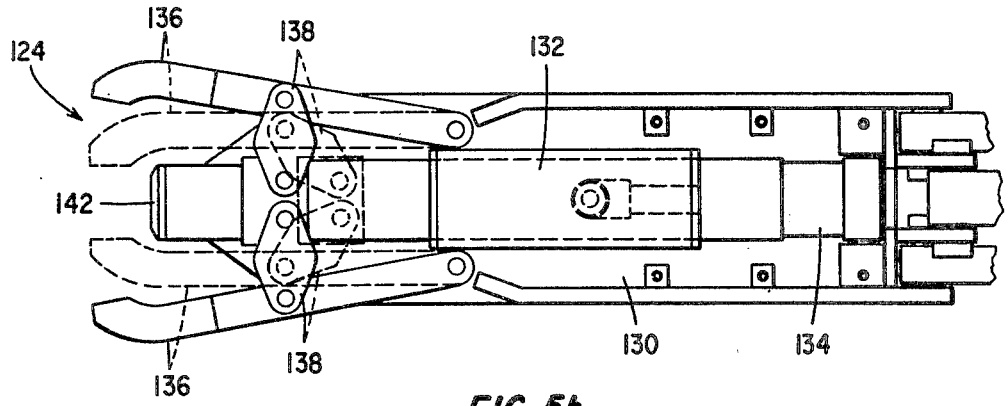
Figure 5C:
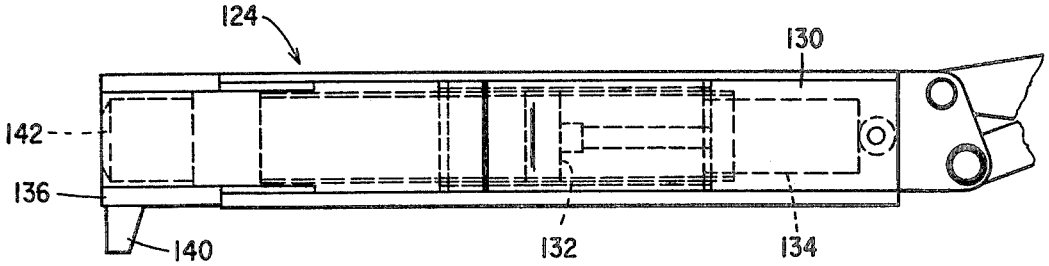

The subframe 132 is normally positioned as shown in FIG. 5*a*. Upon retraction of the cylinder 134, the links 138 function to initially pivot the jaws outwardly to the positions shown in full lines in FIG. 5*b*. At this point the jaws 136 are adapted to receive a replacement tie therebetween. Upon further retraction of the cylinder 134, the links 138 pivot the jaws 136 inwardly to the position shown in dashed lines in FIG. 5*b*. At this point a replacement tie is securely gripped between the jaws 136.

Referring now to FIGS. 3 and 6, an anchor arm assembly 150 is located on the opposite side of the tie replacing system 20 from the articulated arm assembly 110. The anchor arm assembly 150 includes a primary arm 152 which is pivotally supported on the crosshead 66. A hydraulic cylinder 154 is connected between the primary arm 152 and the crosshead 66 for controlling the positioning of the primary arm. The anchor arm assembly 150 further includes a pair of blades 156 mounted on the lower end of the primary arm 152. The blades 156 are positioned in a spaced apart relationship so as to permit a worn tie to pass therebetween. The blades 156 are secured to the primary arm 152 by bolts 158. By this means the overall length of the anchor arm assembly 150 may be adjusted so as to control the extent to which the anchor arm assembly 150 engages the roadbed 30 of the railroad track 22.

A tie thrower assembly 160 is mounted on the primary arm 152 of the anchor arm assembly 150. The tie thrower assembly 160 comprises a pair of opposed jaws 162 which are supported on the primary arm 152 for pivotal movement about mutually perpendicular axes. A first pair of hydraulic cylinders 164 is provided for moving the jaws 162 toward each other and thereby gripping a worn tie between the jaws 162. A second pair of hydraulic cyliners 166 is provided for pivoting these jaws 162 outwardly after the worn tie has been gripped between the jaws. The cylinders 164 and 166 are preferably arranged in such a way that the grip imposed by the cylinders 164 is released prior to the end of the stroke of the cylinders 166. Also, the cylinders 166 may be arranged to provide unequal motions whereby the worn tie can be assumed to follow an angular path relative to the railroad track 22. By this means the tie thrower assembly 160 functions to positively and forcefully propel the worn tie away from the railroad track 22, and in a predetermined direction.

Referring now to FIGS. 1, 2 and 3, the tie replacing system 20 is further provided with a replacement tie handling mechanism 170. The replacement tie handling mechanism 170 includes a tie elevator 172. As is best shown in FIG. 1, the elevator 172 includes a subframe 174 which is pivotally supported on the forward end of the upper portion of the work frame 60. A pair of hydraulic cylinders 176 are provided for selective actuation to pivot the tie elevator 172 between the working position shown in FIG. 1 and the traveling position shown in FIG. 2.

A pair of guide rails 178 extend downwardly from the subframe 174 of the tie elevator 172. The guide rails 178 are embraced by a plurality of rollers 180 mounted on a traveling frame 182. A pneumatic cylinder 184 is connected between the subframe 174 and the traveling frame 182 whereby the traveling frame 182 is selectively raised and lowered relative to the work frame 60.

A pair of opposed tie engaging jaws 186 are pivotally mounted on the opposite ends of the traveling frame 182. Each jaw 186 comprises a plurality of depending spring steel fingers 188 adapted to grip the opposite ends of one or more ties. The jaws 186 are actuated by a pair of pneumatic cylinders 190 connected between the traveling frame 182 and the jaws. The fingers 188 preferably have sufficient length and the cylinders 190 preferably have sufficient stroke to terminate ties which are eight, eight and one-half or nine feet in length between the jaws 186.

A holding conveyor assembly 200 is supported on the work frame 60 beneath the tie elevator 172. The holding conveyor assembly 200 comprises a pair of spaced, parallel roller conveyor sections 202 which extend angularly downwardly relative to the work frame 60 so that ties travel therealong under the action of gravity. The roller conveyor sections 202 are supported on the work frame 60 for extension and retraction under the action of a pair of pneumatic cylinders 204. By this means the conveyor assembly 200 is adapted for retraction to permit the tie elevator 172 to receive one or more ties and for extension to the position shown in FIG. 1 wherein the conveyor assembly 200 is positioned to receive the replacement ties from the tie elevator 172.

The holding conveyor assembly 200 further includes an escapement 206 including tie retaining jaws 208 and pneumatic cylinders 210 for selective actuation to pivot the jaws 208 and thereby release a tie. The escapement 206 is actuated once per operating cycle of the tie replacing system 20. Upon actuation, the escapement 206 releases one tie only to a cross conveyor 212.

Referring now to FIG. 6, the cross conveyor 212 comprises a hydraulic motor 214 and a spindle 216 which cooperate to support a chain 218 for rotation in a substantially horizontal plane. The chain 218 in turn supports a pair of tie pushers 220 mounted at equally spaced intervals on the chain 218. It will therefore be understood that when a replacement tie is released by the escapement 206, it moves downwardly on the holding conveyor assembly 200 under the action of gravity until it engages the cross conveyor 212. At this point the replacement tie is engaged by one of the tie pushers 220 on the chain 218, whereby the replacement tie is moved to the left (FIG. 6).

Upon leftward movement under the action of the cross conveyor 212, the replacement tie is received by a tie support assembly 230. The tie support assembly 230 comprises a pair of opposed jaws 232 both of which are pivotally supported on the primary arm 152 of the anchor arm assembly 150. A pneumatic cylinder 234 is connected between the upper ends of the jaws 232 for selective actuation to open and close the jaws.

A tie feeder 240 is supported on the crosshead 66 above the cross conveyor 212. The tie feeder 240 is supported for substantially vertical reciprocation by a pair of parallel links 242. Reciprocation of the tie feeder 240 is effected by a hydraulic cylinder 244 which is connected between the feeder 240 and the crosshead 66.

Figure 8:
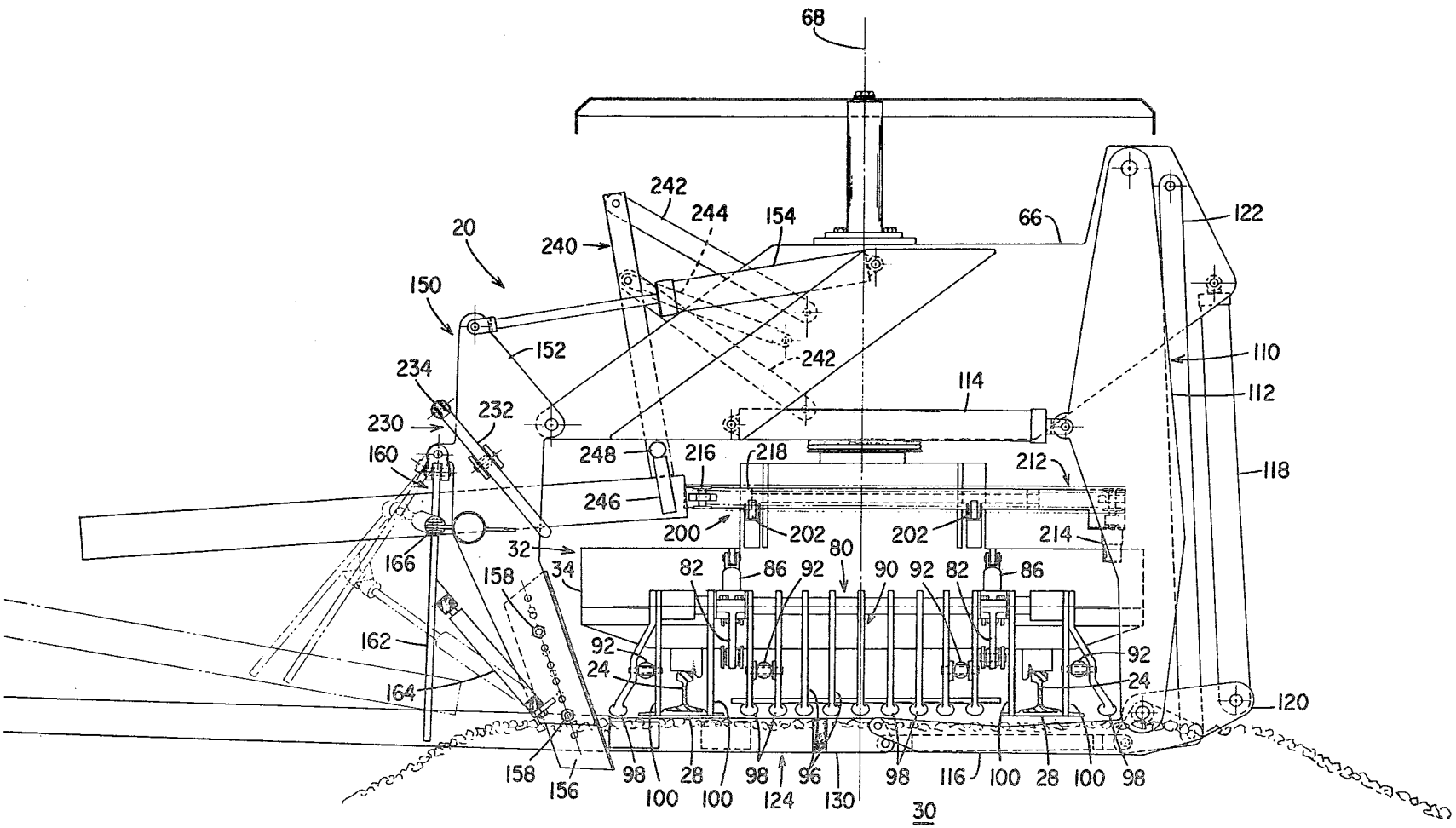
Figure 9:
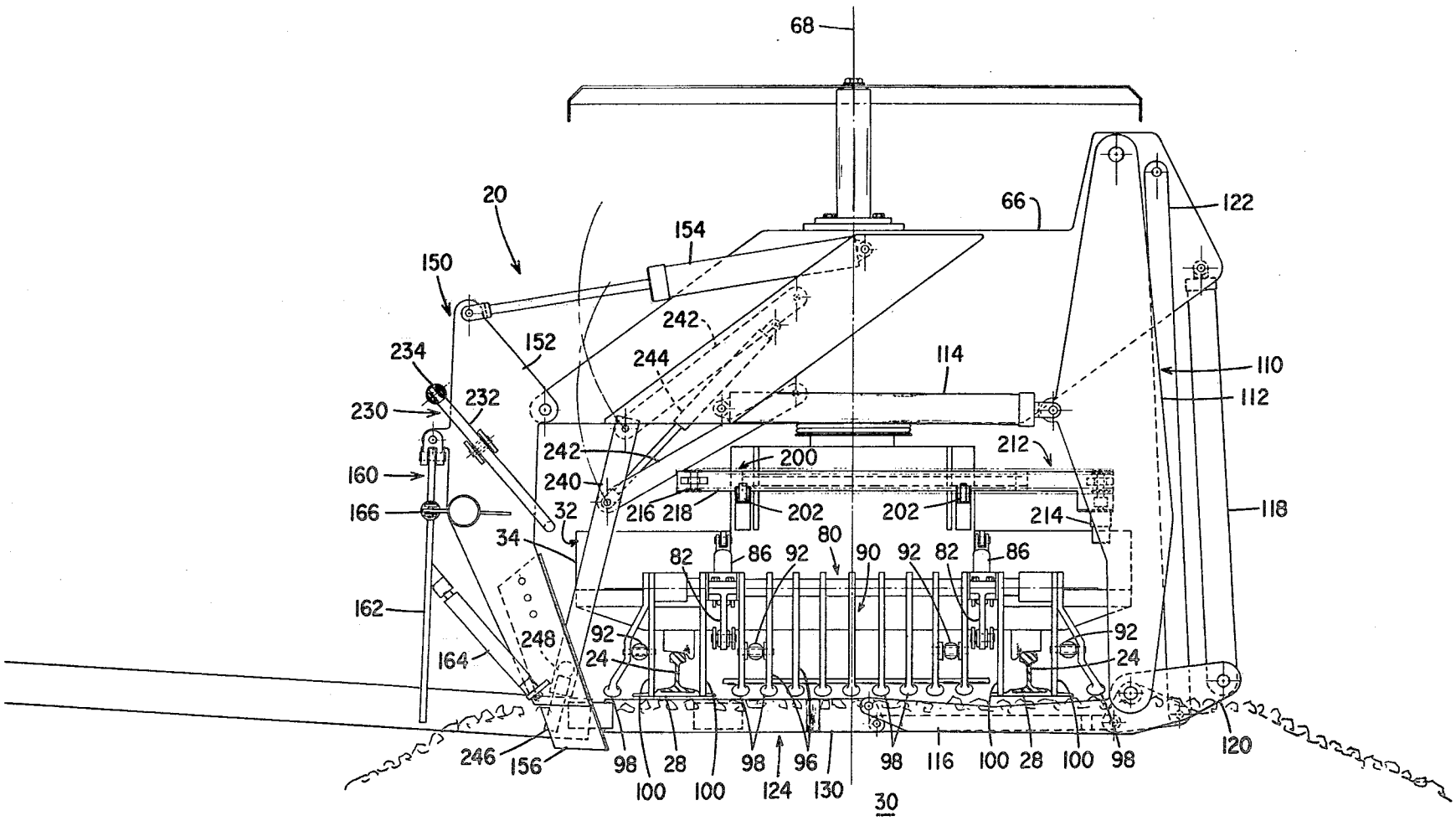

The cross conveyor 212 moves the replacement tie sufficiently leftwardly (FIG. 6) that its center of gravity is positioned beyond the jaws 232 of the tie support assembly 230. To this end the tie feeder 240 is moved downwardly to receive the right hand end of the replacement tie and thereby prevent the replacement tie fromm pivoting counterclockwise under its own weight. As is best shown in FIG. 8, the tie feeder 240 comprises a pair of opposed jaws 246 which are actuated by a pneumatic cylinder to grip the right hand end of the replacement tie following leftward movement of the replacement tie under the action of the cross conveyor 212. The tie feeder 240 further includes a replacement tie guiding roller 248.

Figure 10:
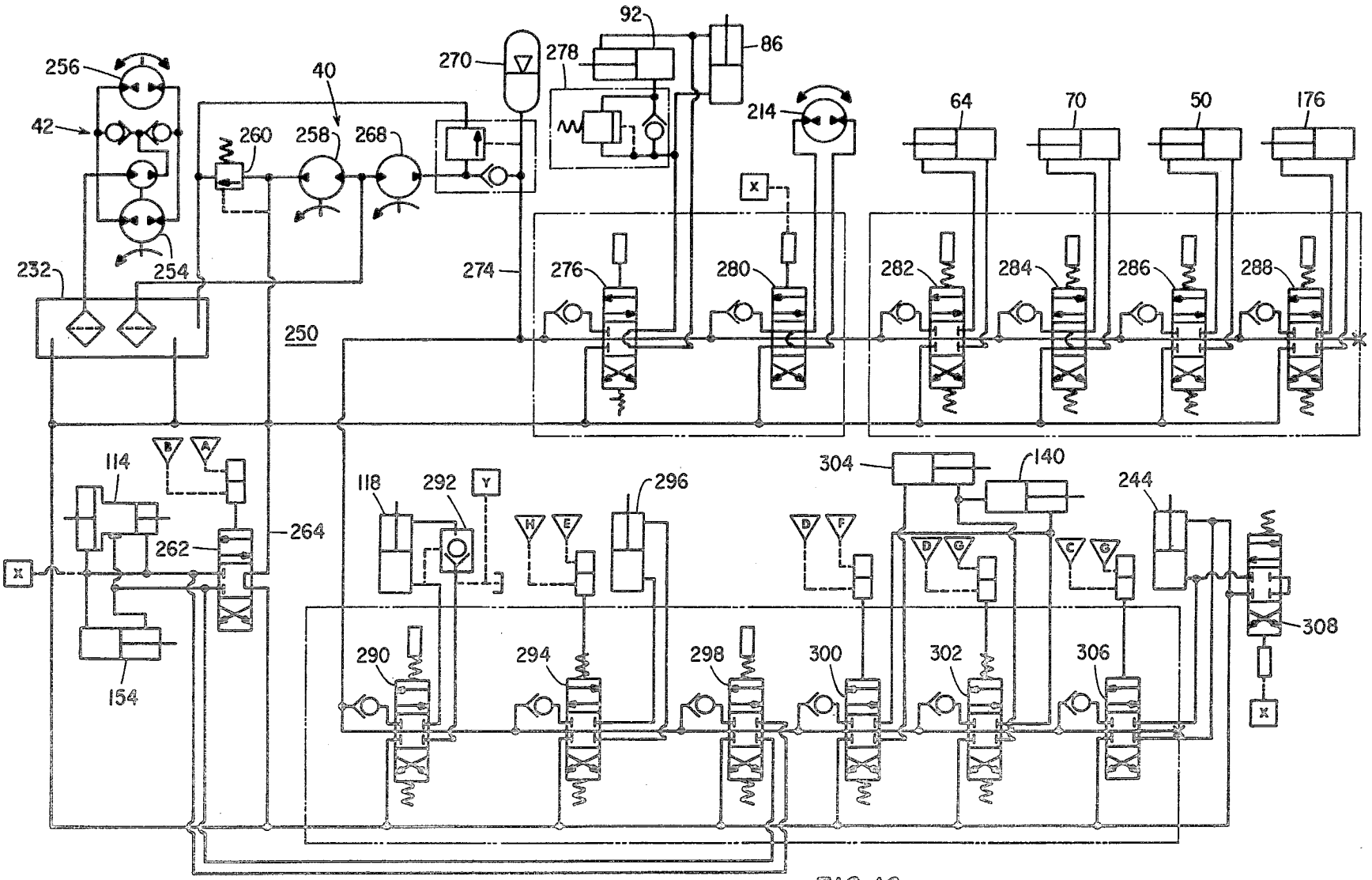
FIG. 10 is a schematic illustration of the hydraulic circuit of the tie replacing system.

Referring now to FIG. 10, a hydraulic circuit 250 utilized in the tie replacing system 20 is schematically illustrated. The circuit 250 includes a hydraulic fluid reservoir 252 which supplied hydraulic fluid to and receives spent hydraulic fluid from the various operating components of the system. For example, the reservoir 252 is connected to the hydrostatic drive 42 which functions to propel the vehicle 32 by means of the wheels 36. The hydrostatic drive 42 includes a pump 254 and a motor 256.

The reservoir 252 is also connected to the pumps 40 of the tie replacing system 20. The pumps 40 include a pump 258 capable of delivering 120 gpm of pressurized hydraulic fluid when driven at 1,800 rpm. The output of the pump 258 is regulated to 2,500 psi by a relief valve 260 and is directed to an air operated three-position, four-way valve 262 through a line 264. The valve 262 functions to control the flow of hydraulic fluid from the pump 258 to the cylinders 114 of the articulated arm assembly 110 and the cylinders 154 of the anchor arm assembly 150. As is clearly shown in FIG. 10, the cylinders 114 comprise double-ended cylinders including relatively large diameter portions and relatively small diameter portions. In the operation of the articulated arm assembly 110, the large diameter portions of the cylinders 114 are actuated first to provide the force necessary to break the worn tie 26 free from the roadbed 30. Thereafter, the small diameter portions of the cylinders 114 are operated to provide full extension of the articulated arm assembly. The valve 262 also actuates a hydraulic pilot system indicated by the square boxes labeled X in FIG. 12.

The pumps 40 of the tie replacing system 20 further include a pump 268 capable of delivering 23 gpm of pressurized hydraulic fluid when operated at a speed of 1,800 rpm. The pump 268 delivers pressurized hydraulic fluid to an accumulator 270 and hence to a line 274 extending to valves controlling the operation of various operating instrumentalities comprising the tie replacing system 20. For example, the line 274 extends to a manually operated, three-position, four-way valve 276 which controls the flow of pressurized hydraulic fluid to the various hydraulic cylinders comprising the tie biter-tie plate holder assembly 80. Upon actuation of the valve 276, the hydraulic cylinders 86 are immediately extended to lower the tie biter-tie plate holding jaws 90 into position. Thereafter, the hydraulic cylinders 92 are actuated to close the jaws 90. Suitable delay in the operation of the cylinders 92 is provided by a sequence valve 278.

The operation of the drive motor 214 of the cross conveyor 212 is controlled by a three-position, four-way valve 280. The valve 280 comprises a hydraulic pilot operated valve. By this means the operation of the cross conveyor 212 is coordinated with the operation of the articulated arm assembly 110 and the anchor arm assembly 150.

The line 274 also functions to direct pressurized hydraulic fluid from the pump 268 to a series of manually operated three-position, four-way valves 282 through 288, inclusive. The valve 282 functions to control the cylinders 64 and hence the pivotal positioning of the work frame 60 relative to the axis 62. The valve 284 controls the operation of the cylinders 70 to selectively position the crosshead 66 in either the right hand, the left hand, or the travel mode. The valve 286 controls the operation of the hydraulic cylinder 50 of the turntable 48. Finally, the valve 288 controls the operation of the hydraulic cylinder 176 which functions to control the pivotal positioning of the tie elevator 172.

A manually operated three-position, four-way valve 290 functions to control the flow of pressurized hydraulic fluid from the line 274 to the cylinder 118 of the articulated arm assembly 110. Control over the operation of the cylinder 118 under the action of the valve 290 is provided by a pilot operated check valve 292. An air operated three-position, four-way valve 294 controls the actuation of the various hydraulic cylinders in the tie thrower assembly 160 all of which are represented by the cylinder 296. A manually operated three-position, four-way valve 298 is utilized to afford manual trim of the positioning of the cylinders 114 of the articulated arm assembly 110 and the cylinders 154 of the anchor arm assembly 150.

An air operated three-position, four-way valve 300 operates in conjunction with an air operated three-position, four-way check valve 302 to control the operation of the cylinder 134 of the tie pushing-tie pulling mechanism 124. The cylinder 134 is operated through a delay cylinder 304 whereby the jaws 136 of the tie pushing-tie pulling mechanism 124 are first opened to receive a replacement tie, and are then closed to securely clamp the replacement ties during the tie pulling operation. Similar control over the operation of the hydraulic cylinder 244 of the tie feeder assembly 240 is provided by an air operated three-position, four-way valve 306 operating in conjunction with a hydraulic pilot operated three-position, four-way valve 308.

Figure 11:
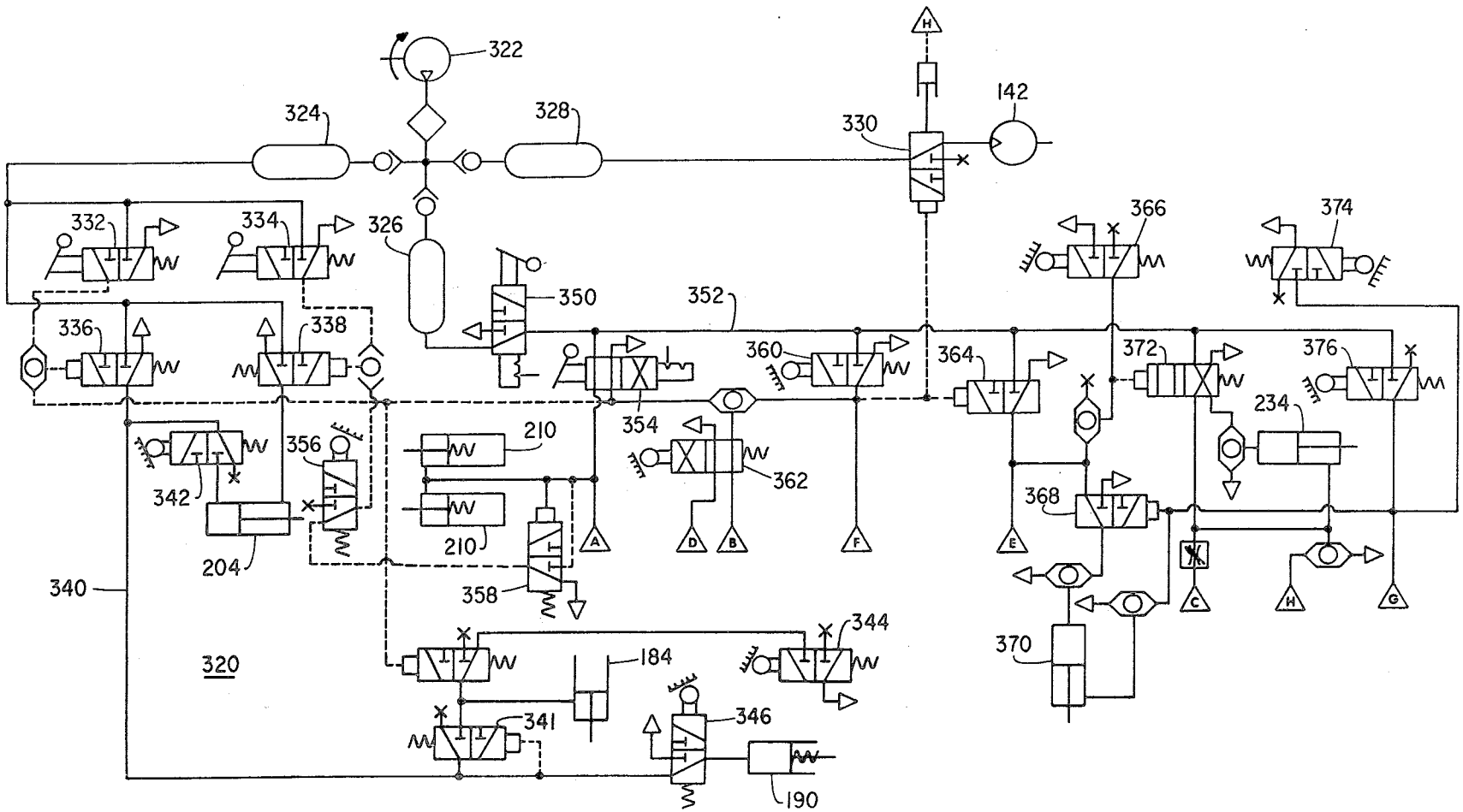
FIG. 11 is a schematic illustration of the pneumatic circuit of the tie replacing system.

A pneumatic circuit 320 utilized in the tie replacing system 20 is illustrated in FIG. 11. The hydraulic circuit 250 and the pneumatic circuit 320 of the system 20 are interconnected at the points designated by triangles in FIGS. 10 and 11. Each triangle is identified by a letter to signify interconnections between the hydraulic and pneumatic circuits.

The pneumatic circuit 320 includes a pump 322 which is driven by the engine 38. Compressed air from the pump 322 is directed to a pair of 2 $ft^3$ receivers 324 and 326 and a 4 $ft^3$ receiver 328. Compressed air from the receiver 328 is directed through a pilot operated valve 330 to the vibrator 142 of the tie pushing-tie pulling mechanism 124.

Compressed air from the receiver 324 is directed to a pair of manually operated valves 332 and 334 which function to control the positioning of the tie elevator 172. A pair of automatic valves 336 and 338 correspond to the valves 332 and 334, respectively. The output of the valve 336 extends to a line 340 which is connected to the cylinders 184 through a pilot operated valve 341. The outputs of the valves 336 and 338 are jointly connected to the cylinders 204 which function to extend and retract the conveyor sections 202 of the holding conveyor assembly 200. The operation of the cylinders 204 is regulated by three position controlled valves 342, 344 and 346.

The output from the receiver 326 is directed to a manually operated control circuit 350. The output of the valve 350 extends to a line 352. A manually operated valve 354 is connected to the line 352 and functions to control the direction of movement of the articulated arm assembly 110. The valve 354 also controls the operation of the cylinders 210 of the escapement 206 by means of a position controlled valve 356 and a relay 358.

A position controlled valve 360 is coupled to the line 352, and a position controlled valve 362 is coupled to the output of the valve 360 and to the output of the valve 354. The valve 360 is responsive to full extension of the tie pushing-tie pulling mechanism 124 under the action of the articulated arm assembly 110, and the valve 362 is responsive to full retraction of the tie pushing-tie pulling mechanism 124.

A relay valve 364 and a position controlled valve 366 function in combination with a pilot operated valve 368 to control the operation of a cylinder 370 which operates the clamps of the tie feeder 240. A relay valve 372 controls the operation of the cylinder 234 of the tie support assembly 230. The pneumatic circuitry 320 further includes a pair of position controlled valves 374 and 376 responsive to the positioning of the tie feeder 240.

OPERATION

Figure 12:
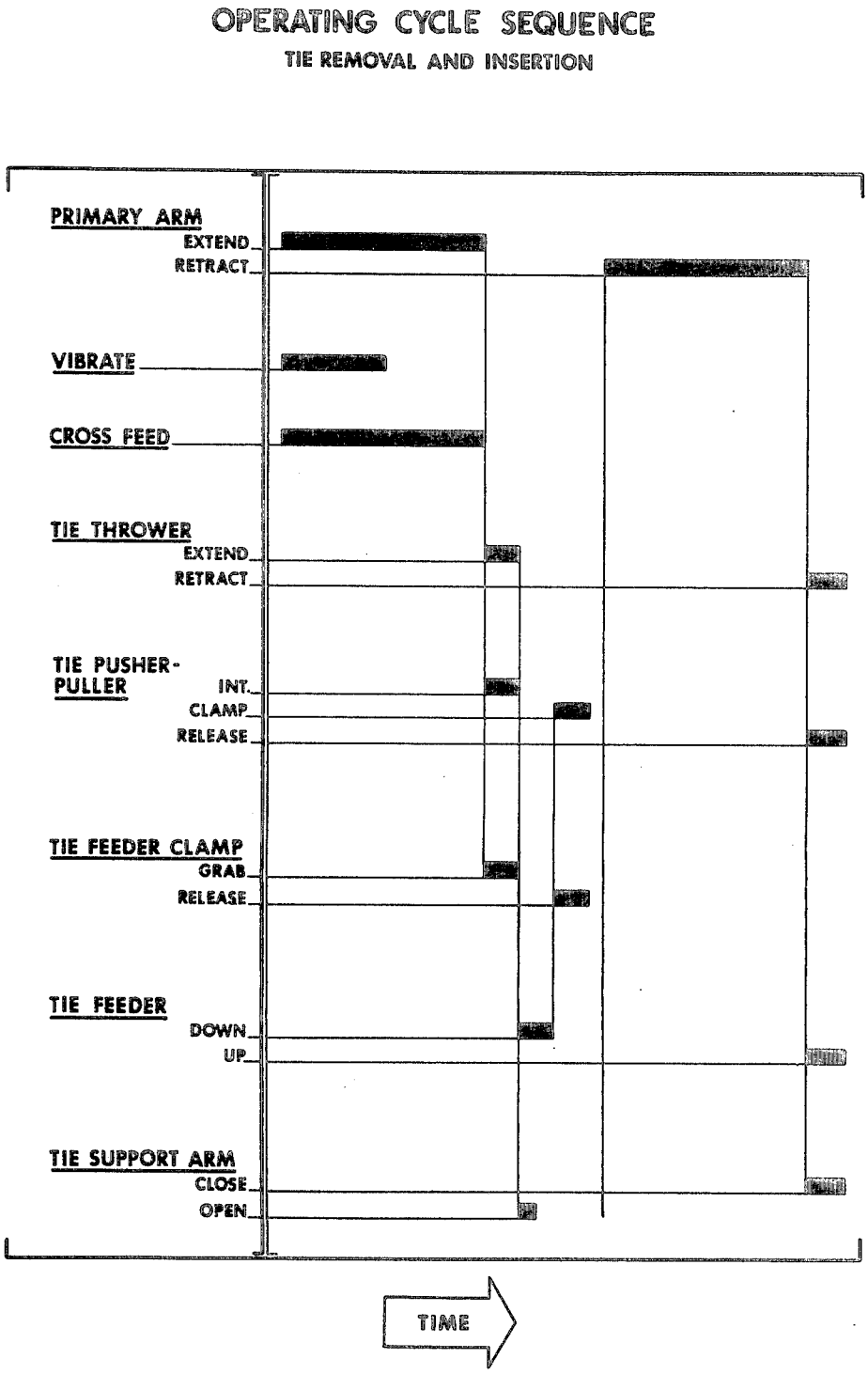
FIG. 12 is a timing diagram showing the sequence of operation of the various component parts of the tie replacing system.

The operation of the tie replacing system 20 will be best understood by referring to FIGS. 6 through 10 when taken in conjunction with FIG. 12. The vehicle 32 is initially operated to position the crosshead 66 of the tie replacing system 20 in alignment with a worn tie 26*w* of the railroad track 22. Thereafter, the cylinders 86 are actuated to lower the subframe 82 of the tie biter-tie plate holder assembly 80. Following the operation of the cylinders 86, the cylinders 92 are actuated to close the jaws 90.

As the jaws 90 are closed, the teeth 96 function to remove any portion of the worn tie 26*w* which projects above the under surfaces of the tie plates 28. At the same time the members 100 close on the tie plates 28 to retain the tie plates in engagement with the under surface of the rails 24.

Figure 7:
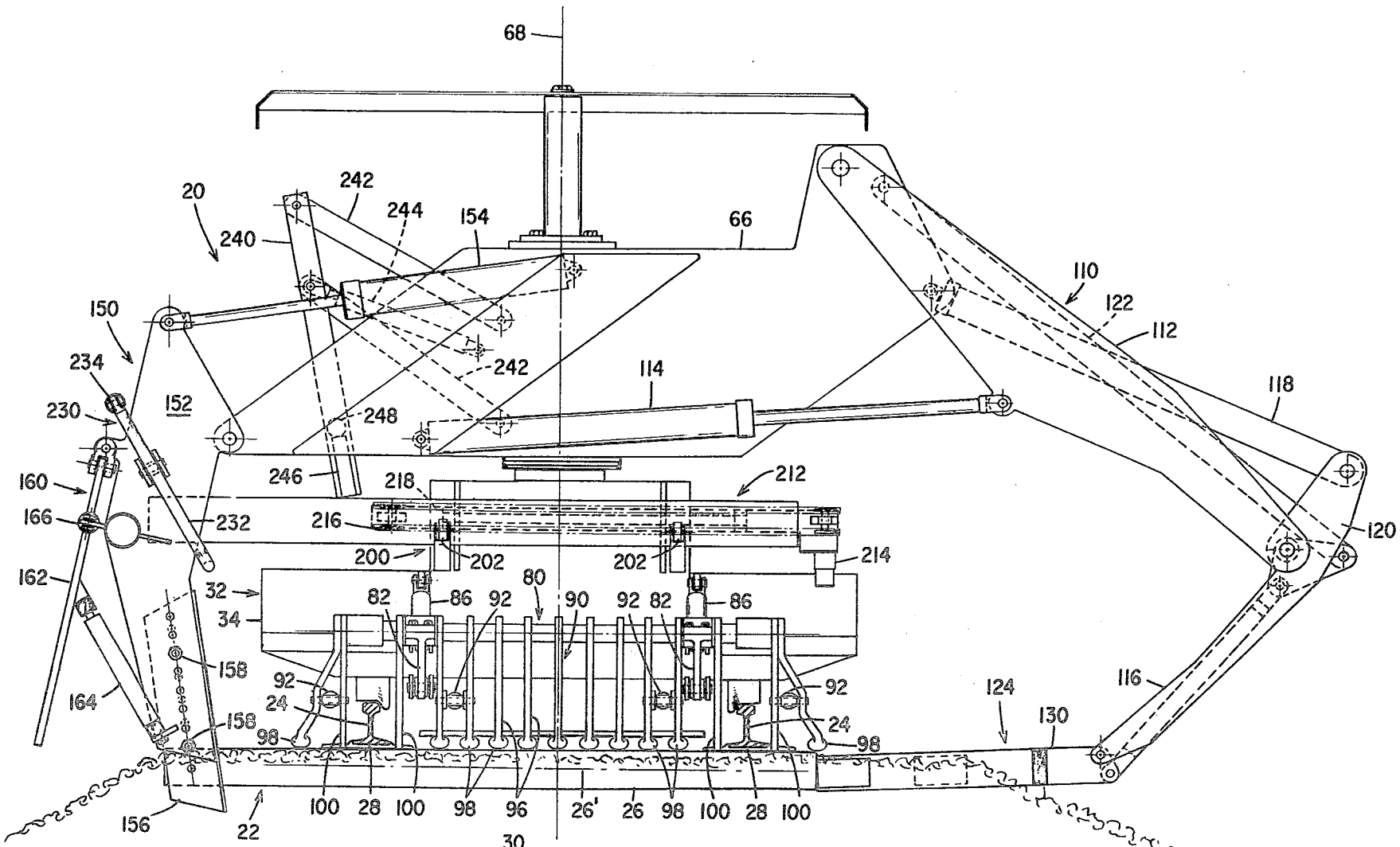

Following the operation of the tie biter-tie plate holding assembly 80, the hydraulic cylinder 154 is actuated to position the blades 156 of the anchor arm assembly 150 in engagement with the roadbed 30 which supports the railroad track 22. Thereafter, the hydraulic cylinders 114 and 118 are actuated to position the distal end of the tie pushing-tie pulling mechanism 124 in alignment with the end of the worn tie remote from the anchor arm assembly 150. At this point the component parts of the tie replacing system 20 are positioned substantially as shown in FIG. 7.

The next step in the operation of the tie replacing system 20 comprises actuation of the tie pushing-tie pulling mechanism 124 to push the worn tie 26*w* out from beneath the tie plates 28 and the rails 24 of the railroad track 22. This is accomplished by actuating the hydraulic cylinders 114 to move the tie pushing-tie pulling mechanism 124 to the left (FIG. 7). Due to the geometry of the component parts of the articulated arm assembly 110, the hydraulic cylinder 114 functions to move the tie pushing-tie pulling mechanism 124 along a path extending substantially congruent to the axis 26' of the worn tie 26*w*. During the tie pushing operation, the jaws 136 of the tie pushing-tie pulling mechanism 124 are retained in the retracted positions shown in FIG. 5*a*. The vibrator 142 is operated during the tie pushing operation to generate non-sonic vibrations having substatial amplitude which facilitates removal of the worn tie from the roadbed 30. It has been found that the force required to effect removal of the worn tie is reduced by approximately 50% when the tie pushing-tie pulling mechanism is vibrated during the tie pushing operation. It will be appreciated that the scarifyer 140 also functions during the tie pushing operation to disrupt the portion of the roadbed lying just under the tie 26. This is to facilitate the positioning of the replacement tie in the roadbed 30.

An important feature of the present invention comprises the use of the anchor arm assembly 150 to direct the reaction force which is generated during the tie pushing operation into the roadbed 30. It will be noted that both the anchor arm assembly 150 and the articulated arm assembly 110 are pivotally supported on the crosshead 66. For this reason, and since the blades 156 of the anchor arm assembly 150 are positioned directly oppositely to the point at which the pushing force is applied to the worn tie, substantially the entire reaction force is transferred by the anchor arm assembly 150 into the roadbed 30. This is important for a number of reasons. First, since the reaction force is not applied to the rails 24, there is no tendency for the rails to skew or become loosened due to the operation of the tie replacing system 20. Also, the strength, etc. of the frame and other operating components of the vehicle 32 do not become important design considerations as would be the case if the vehicle 32 were used to absorb the reaction force generated during the tie pushing operation.

As the worn tie is pushed out from beneath the railroad track 22 by the tie pushing-tie pulling mechanism 124, it is received by the tie throwing assembly 160. The cylinders 164 are initially actuated to grip the worn tie between the jaws 162. Thereafter, the cylinders 166 are actuated to pivot the jaws 162 and the worn tie gripped therebetween outwardly. The cylinders 164 are released prior to the end of the stroke of the cylinders 166, whereby the worn tie is released to continue its outward movement. The operation of the tie throwing assembly 160 in propelling the worn tie away from the railroad track 22 is illustrated in phantom lines in FIG. 8.

FIG. 8 also illustrates the conclusion of the various steps involved in the positioning of the replacement tie 26*r*. The replacement tie 26*r* is now supported by the tie support apparatus 230 with the center of gravity of the replacement tie 26*r* positioned substantially to the left of the jaws 232. The replacement tie 26*r* is prevented from pivoting counterclockwise by the tie feeder 240 which has been lowered into engagement with the right hand end of the replacement tie. Also, the right hand end of the replacement tie 26*r* is gripped between the jaws 246 of the tie feeder 240.

As soon as the worn tie 26*w* has been propelled away from the track 22 by the tie throwing assembly 160, the cylinder 234 is actuated to open the jaws 232 of the tie support apparatus 230. This releases the replacement tie 26*r* for downward movement. At the same time the tie feeder 240 is actuated to move the right hand end of the replacement tie downwardly. It should be noted that the major portion of the replacement tie moves downwardly under the action of gravity following opening of the jaws 232. The tie feeder 240 is preferably operated to accelerate the right hand end of the replacement tie at substantially the same rate, so that the replacement tie 26*r* moves downwardly in a substantially horizontal orientation.

The tie feeder 240 functions to engage the right hand end of the replacement tie 26*r* with the tie pushing-tie pulling mechanism 124. To this end, the cylinder 134 of the tie pushing-tie pulling mechanism 124 is operated in synchronism with the operation of the tie feeder 240 to first open the jaws 136 to the fullest extent possible. This permits the tie inserting and guiding apparatus to position the right hand end of the replacement tie 26*r* between the jaws 136. Thereafter, the operation of the cylinder 134 is continued to clamp the jaws 136 in engagement with the replacement tie 26*r*.

As soon as the replacement tie 26*r* is gripped between the jaws 136 of the tie pushing-tie pulling mechanism 124, the jaws 246 of the tie feeder 240 are released. However, the tie feeder 240 is not withdrawn at this time. Instead, the tie feeder 240 remains in position, whereby the roller 248 serves to guide the replacement tie into position beneath the tie plates 28 of the rails 24 of the railroad track 22. The rounded heels 98 of the teeth 96 of the jaws 90 of the tie biter-tie plate holder assembly 80 also serve a guiding function. There is a natural tendency of the replacement tie 26*r* to ride upwardly as it is drawn through the roadbed 30. Any such action is prevented by the heels 98 of the teeth 96. Also, the teeth 96 function to scrape away any gravel or other debris that might accumulate on top of the replacement tie. This assures that the replacement tie 26*r* will be positioned beneath the tie plates 28 with no foreign matter having accumulated therebetween.

As is most clearly shown in FIG. 10, the replacement tie 26*r* is pulled through the roadbed 30 by extending the hydraulic cylinder 114 of the articulated arm assembly 110. During this action the vibrator 142 is operated to facilitate movement of the replacement tie through the roadbed. The scarifyer 140 also functions during the tie pulling operation to loosen the portion of the roadbed lying just under the path of travel of the replacement tie, whereby movement of the replacement tie 26*r* through the roadbed is facilitated.

The movement of the replacement tie 26*r* through the roadbed 30 under the action of the articulated arm assembly 110 is continued until the replacement tie is properly positioned relative to the remaining components of the railroad track 22. At this point the cylinder 134 of the tie pushing-tie pulling mechanism 124 is operated to release the replacement tie. The cylinders 92 of the tie biter-tie plate holder assembly 80 are also extended to release the tie plates 28. Thereafter, the cylinders 86 are actuated to raise the tie biting and tie plate gripping assembly. The vehicle 32 is then actuated to propel the tie replacing system 20 into alignment with the next tie to be replaced.

It will be appreciated that in the event extended travel is required, the various component parts of the tie replacing system 20 may be manipulated to the transportation position as is illustrated in FIG. 2. Moreover, should it be necessary or desirable to remove the next worn tie from the opposite side, the component parts of the tie replacing system 20 may be positioned in the opposite orientation as illustrated in the Drawings. However, the sequence of operation as described hereinbefore is not changed in any significant way by the reverse positioning of the component parts of the tie replacing system 20.

From the foregoing, it will be understood that the present invention comprises a novel tie replacing system which functions to automatically replace worn ties in a railroad track. The use of the invention is highly advantageous in that worn ties are replaced considerably more economically and considerably more rapidly than has been possible heretofore. Other advantages deriving from the use of the invention will readily suggest themselves to those skilled in the art.

Although preferred embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

What is claimed is:

1. A process for replacing worn ties from a railroad track of the type comprising longitudinally extending metal rails supported on transversely extending wooden ties by metal tie plates and a ballast roadbed supporting and at least partially surrounding the ties including the steps of:

applying a substantially axially directed force to a worn tie in the railroad track and thereby pushing the worn tie out from under the rails and the tie plates and out of the roadbed of the railroad track; and simultaneously scarifying the portion of the roadbed immediately adjacent the position previously occupied by the worn tie and thereby facilitating the positioning of a replacement tie in the roadbed beneath the rails and the tie plates of the railroad track.

2. The process of replacing worn ties according to claim 1 wherein the tie pushing step is further characterized by simultaneously applying non-sonic vibrations of substantial amplitude to the worn tie and thereby facilitating movement of the worn tie out of the roadbed of the railroad track.

3. The process of replacing worn ties according to claim 1 further characterized by removing portions of the worn tie extending above the under surfaces of the tie plates prior to the tie pushing step.

4. The process of replacing worn ties according to claim 1 further characterized by:

positioning a replacement tie for reinsertion under the metal rails and tie plates; and applying a substantially axially directed force to the replacement tie for pulling the replacement tie under the rails and the tie plates in the location previously occupied by the worn tie.

5. The tie replacement process according to claim 4 further characterized by continuously retaining the tie plates in engagement with the under surfaces of the rails throughout the replacement steps.

6. The tie replacement process according to claim 4 further characterized by:

engaging an anchor mechanism with the roadbed at one end of the worn tie; and pushing the worn tie out of the roadbed in the direction of the anchor mechanism so that the reaction force generated by the tie pushing step is directed into the roadbed by the anchor mechanism.

7. The tie replacement process according to claim 4 wherein the tie pushing and tie pulling steps are both characterized by vibrating the worn tie to facilitate movement of both the worn tie and the replacement tie through the roadbed.

8. The tie replacement process according to claim 4 further characterized by removing portions of the worn tie extending above the upper surfaces of the tie plates prior to the tie pushing step.

9. The tie replacement process according to claim 8 wherein the step of removing portions of the tie projecting above the upper surfaces of the tie plates is carried out by engaging opposed tie biting jaws with the upper portions of the worn tie at a point substantially aligned with the under surfaces of the tie plates and then drawing the jaws together to remove the portions of the tie projecting above the upper surfaces of the tie plates by a shearing action.

10. The tie replacement process according to claim 1 wherein the step of applying an axially directed force to the worn tie is characterized by advancing a tie pushing-tie pulling mechanism along a path extending substantially axially of the worn tie and thereby pushing the worn tie out from beneath the tie plates and the rails and out of the roadbed of the railroad track.

11. The tie replacement process according to claim 10 and further comprising the step of securing a replacement tie to the tie pushing-tie pulling mechanism after the worn tie has been pushed from beneath the tie plates and the rails.

12. The tie replacement process according to claim 11 wherein the step of engaging the replacement tie with the tie pushing-tie pulling mechanism is further characterized by:

positioning the replacement tie directly above the point at which the worn tie is removed from the roadbed;

releasing one end of the replacement tie to fall under the action of gravity and simultaneously forcing the other end of the replacement tie downwardly; and simultaneously actuating a tie gripping mechanism mounted on the distal end of the tie pushing-tie pulling mechanism to engage the replacement tie.

13. The tie replacement process according to claim 11 wherein the step of securing the replacement tie to the tie pushing-tie pulling mechanism is further characterized by:

receiving the replacement tie in gripping mechanisms mounted at one end of a tie inserting and tie guiding mechanism;

subsequently moving the tie inserting and tie guiding mechanism downwardly to engage the replacement tie with the tie pushing-pulling mechanism; and maintaining the tie inserting and tie guiding mechanism in engagement with the replacement tie during the tie pulling step and thereby guiding the replacement tie into position in the roadbed and beneath the tie plates and the rails of the railroad track.

14. The tie replacement process according to claim 12 and further characterized by maintaining the tie biting jaws in closed positions during the tie pulling and tie pushing steps so that the jaw function to guide the replacement tie into position during the tie pulling step.

* * * * *

UNITED STATES PATENT AND TRADEMARK OFFICE

CERTIFICATE OF CORRECTION

PATENT NO. : 4,018,165

DATED : April 19, 1977

INVENTOR(S) : JOHN F. BRYAN, JR.

It is certified that error appears in the above-identified patent and that said Letters Patent are hereby corrected as shown below:

Column 1, lines 5-50 should have been noted as being part of the Abstract;

Column 2, line 34 "," at end of sentence should be --.--;

Column 5, line 43 "the" should be --and--;

Column 6, line 23 "mechanicam" should be --mechanism--;

Column 8, line 31 "fromm" should be --from--;

Column 16, line 8 "12" should be --13--;

Column 16, line 10 "jaw" should be --jaws--.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*